US008528910B2

(12) United States Patent
Escobar

(10) Patent No.: US 8,528,910 B2
(45) Date of Patent: Sep. 10, 2013

(54) WALL-MOUNTABLE GAME DEVICE

(76) Inventor: Adam Escobar, Pembroke Pines, FL (US)

( * ) Notice: Subject to any disclaimer, the term of this patent is extended or adjusted under 35 U.S.C. 154(b) by 247 days.

(21) Appl. No.: 12/985,034

(22) Filed: Jan. 5, 2011

(65) Prior Publication Data

US 2011/0163498 A1 Jul. 7, 2011

Related U.S. Application Data

(60) Provisional application No. 61/292,328, filed on Jan. 5, 2010.

(51) Int. Cl.
*A63B 63/00* (2006.01)

(52) U.S. Cl.
USPC ..... 273/398; 273/400

(58) Field of Classification Search
USPC ..... 273/398–402, 407; 473/476–478, 473/195–197, 454–456
See application file for complete search history.

(56) References Cited

U.S. PATENT DOCUMENTS 827,626 A * 7/1906 Gillet ..... 273/402
4,022,472 A * 5/1977 Seals ..... 273/400
4,919,436 A * 4/1990 Buselli ..... 273/348.4
4,923,201 A * 5/1990 Nichol et al. ..... 273/371
4,938,485 A * 7/1990 Hockridge et al. ..... 273/401
5,524,901 A * 6/1996 Bison et al. ..... 473/197
5,536,017 A * 7/1996 Salisian ..... 273/375
6,179,295 B1 * 1/2001 Lanza ..... 273/402
6,192,635 B1 * 2/2001 Zheng ..... 135/126
6,244,598 B1 * 6/2001 Conville ..... 273/402
2005/0127609 A1 * 6/2005 Raslowsky ..... 273/402
2006/0125186 A1 * 6/2006 Digges et al. ..... 273/402
2007/0063447 A1 * 3/2007 Gholson et al. ..... 273/400
2010/0109248 A1 * 5/2010 Held et al. ..... 273/402

* cited by examiner

*Primary Examiner* — Mark Graham
(74) *Attorney, Agent, or Firm* — Lott & Fischer, PL

(57) ABSTRACT

A game device having a top panel, a bottom panel, a left panel, a right panel, and a back panel. The top panel is disposed laterally between the left panel and the right panel, with the top panel oriented substantially perpendicular to the left and right panels. The back panel is disposed transversely between the left and right panels. The bottom panel is disposed laterally between the left and right panels. The front edge of the bottom panel terminates at the front edge of the top panel, and the back edge of the bottom panel terminates at the bottom edge of the back panel. The top panel has one or more apertures adapted to removably retain one or more cups. A cup support panel may be located below and oriented parallel with the top panel. The game device is adapted to be secured to a rigid structure, such as a wall, by hooks, hangers, or the like.

12 Claims, 8 Drawing Sheets

WALL-MOUNTABLE GAME DEVICE

PRIORITY INFORMATION

This application claims the benefit of U.S. Provisional Application No. 61/292,328, filed Jan. 5, 2010.

TECHNICAL FIELD

The present invention relates generally to game devices and more specifically to a wall-mountable game device useful in a variety of applications.

BACKGROUND OF THE INVENTION

The present invention relates to a game device that is intended to be mounted to a wall surface. In one example, the present invention is used to play a "ping-pong" game wherein the present invention is mounted to a rigid structure and supports one or more cups, optionally filled with a liquid, whereby the player attempts to throw or hit a ping-pong ball or other object into the cup.

SUMMARY OF THE INVENTION

Disclosed herein are various embodiments of a game device adapted to be used in conjunction with one or more "playing" cups, in some embodiments, the game device has a top panel, a bottom panel, a left panel, a right panel, and a back panel. The top panel is disposed laterally between the left panel and the right panel, with the top panel oriented. substantially perpendicular to the left and right panels. The back panel is disposed transversely between the left and right panels. The bottom panel is disposed laterally between the left and right panels. The front edge of the bottom panel terminates at the front edge of the top panel, and the back edge of the bottom panel terminates at the bottom edge of the back panel. The top panel has one or more apertures adapted to removably retain one or more cups. A cup support panel adapted to vertically support one or more cups may be located below, and oriented parallel to, with the top panel.

In other embodiments, the game device comprises a top panel, a left panel, and a right panel. The top panel is disposed laterally between the left and right panels, the top panel oriented substantially perpendicular to the left and right panels. The top panel has one or more apertures adapted to removably retain one or more cups and is adapted to be secured to a rigid structure. The device further comprises a cup support panel, adapted to vertically support one or more cups, disposed between the left and right panels, oriented substantially perpendicular to the left and right panels, at an elevation below the top panel.

The various embodiments of the game device of the present invention are adapted to be secured to a rigid, structure by hooks, hangers, or the like. In some embodiments, the device may be pivotably engaged to a rigid, structure such that it pivots upward for storage.

Accordingly, it is an object of the present invention to provide a convenient, self-contained, and economical game device that is adapted to be used in a variety of operational lodes, including in conjunction with cups and ping-pong balls. This and other objectives of the various embodiments of the present invention will become readily apparent in the following specification and appended claims.

DETAILED DESCRIPTION OF THE INVENTION

Figure 1:
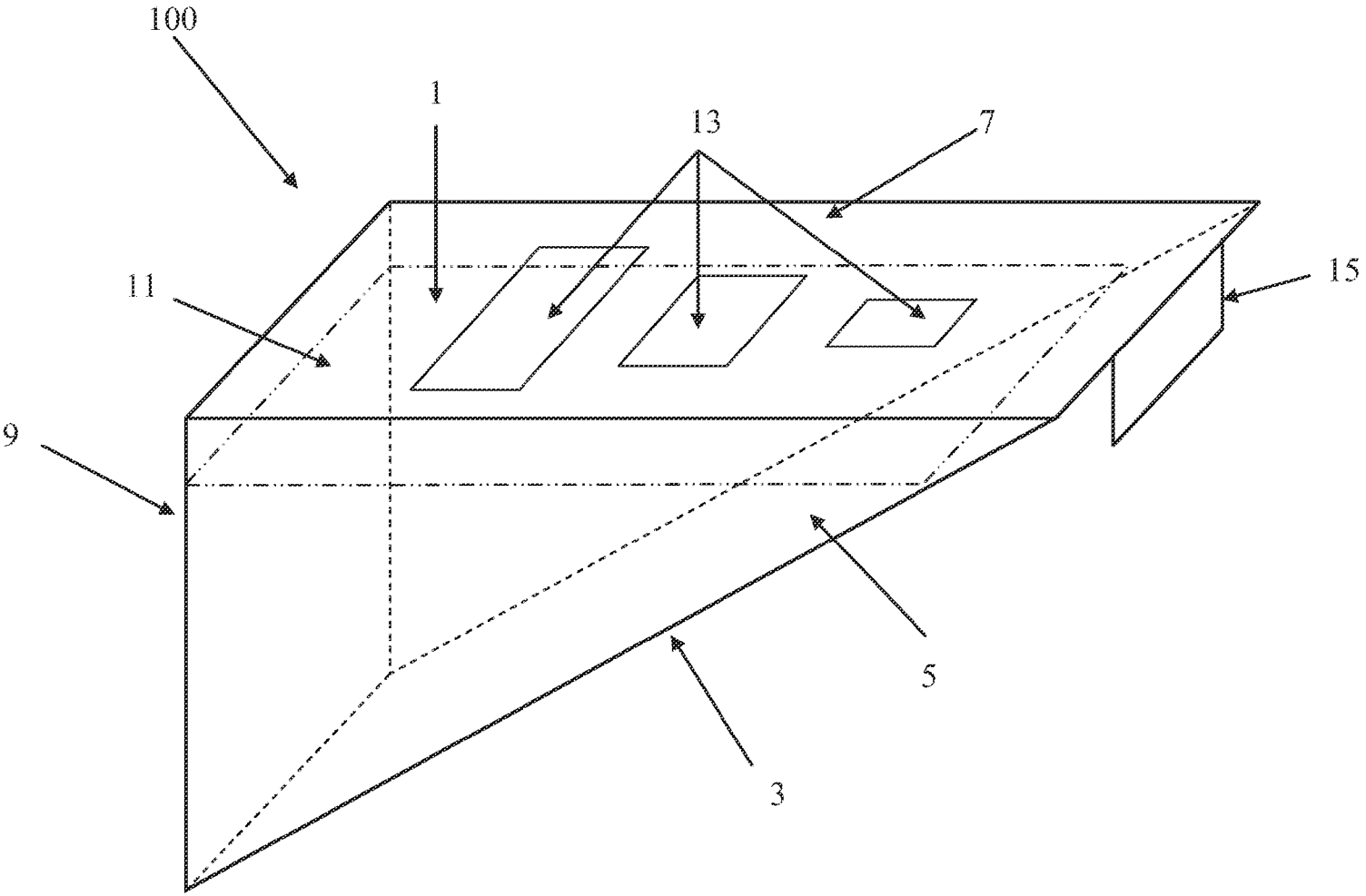
FIG. 1 is an aspect view of one embodiment of the present invention.

FIG. 1 depicts one embodiment of the game device 100 of the present invention in a 5-sided "wedge-shaped" configuration. Shown are top panel 1, bottom panel 3, left panel 5, right panel 7, and back panel 9. In some embodiments, the sides of top panel 1 are disposed between left panel 5 and right panel 7, and the front and back of top panel 1 are disposed between bottom panel 3 and back panel 9, respectively. In some embodiments, bottom panel 3 is at an angle disposed laterally between left panel 5 and right panel 7, with its front edge terminating at the front edge of top panel 1 and its rear edge terminating at the bottom edge of back panel 9. Accordingly, top panel 1 is oriented substantially perpendicular with respect to the vertically oriented left panel 5, right panel 7 and back panel 9. Back panel 9 is vertically oriented, but is transversely disposed between left panel 5 and right panel 7. It is understood that left and right panels 5 and 7 may be of any suitable shape, such as wedge-shaped, rectangular, triangular, or the like. Further, in some embodiments, left and right panels 5 and 7 comprise a series of "frame" elements, rather than a planar surface.

Also shown is cup support panel 11 and apertures 13. Cup support panel 11 and apertures 13 work together to retain one or more cups used in conjunction with the device 100 of the present invention. In sonic embodiments, cup support panel 11 is oriented substantially parallel to, and at an elevation below, top panel 1. In some embodiments, the sides of the cup support panel 11 are disposed between left panel 5 and right panel 7, and the front and back of cup support panel 11 are disposed between bottom panel 3 and back panel 9, respectively. Accordingly, cup support panel 11 is adapted to vertically support cups that are disposed within device 100.

Figure 2:
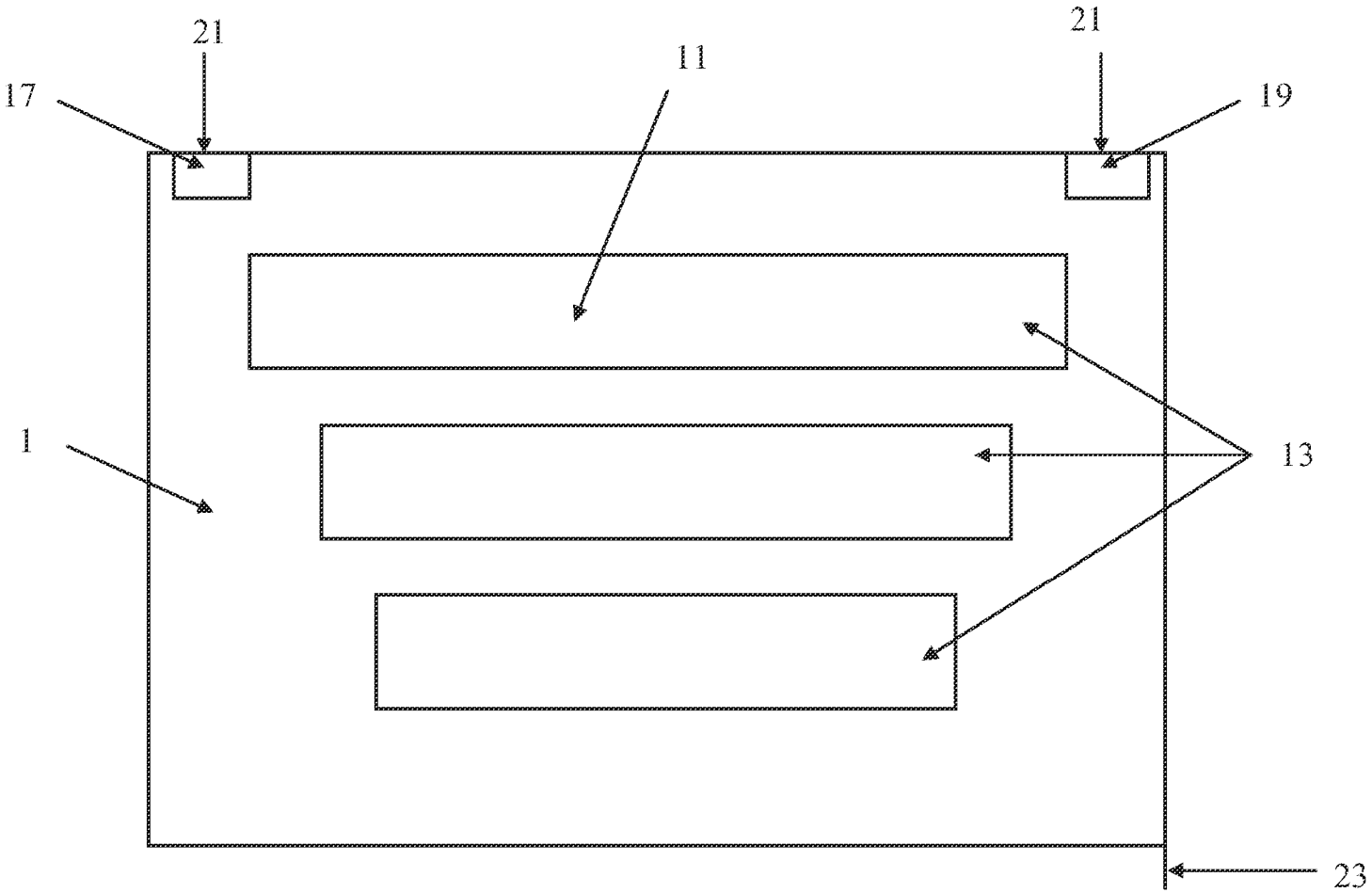
FIG. 2 is a top view of one embodiment of the present invention.

With reference to FIG. 2, apertures 13 are rectangular "slots" on top panel 1 and are adapted to laterally me or more cups placed therein. As shown, in some embodiments, top panel 1 has three apertures 13 each dimensioned to removably retain an increasing number of cups. For example, first aperture 13 may accommodate 1 cup, the second aperture 13, 2 cups, and the third aperture 13, 3 cups. In this example, the cups placed in apertures 13 will form a "pyramid" shape. However, as the dimensions of the present invention are only limited by preference, the device 100 as a whole and specifically apertures 13 may be dimensioned to accommodate any desired number of cups, in any desired arrangement. Accordingly, apertures 13 may be substantially equal in size such that the cups placed therein form a rectangular or square "grid" rather than the aforementioned "pyramid" shape. It is understood that because the apertures removably retain the cups, the user is not confined to any given arrangement of cups; rather, the user can choose the number, size, and arrangement of cups as desired.

In some embodiments, apertures 13 may be circular openings, rather than rectangular "slots." In this configuration, apertures 13 may be dimensioned to removably retain a cup such that when the cup is placed through an aperture 13, the bottom of the cup rests on bottom panel cup support panel 11, for vertical support, and the aperture 13 is only slightly larger than the cross-section of a cup at its point of contact with top panel 1. In some embodiments, cup support panel 11 may be omitted and top panel 1 may have appropriately sized apertures 13 which are capable of supporting the cups laterally only, without the need to support the cups from the bottom. This embodiment is well-suited when using cups that have a tapered or conical shape. According, top panel 1 may have any number, size, and arrangement of apertures 13 as desired. For exemplary purposes only, however, top panel 1 may have six (6) apertures 13 arranged in a "pyramid" configuration. Alternatively, top support 1 may have ten (10) apertures 13 also in a "pyramid" configuration. Again, because the dimensions of the device 100 are not to be construed as limiting, top panel 1 may have any number and arrangement of apertures 13. The size of the apertures 13, i.e. the circumference thereof, may be chosen based on the preferred cup size (e.g., 12 ounce, 16 ounce) to be supported by the present invention. Of course it may be desirable to select an aperture size that is suitable for retaining a wide variety of cup sizes.

Figure 10:
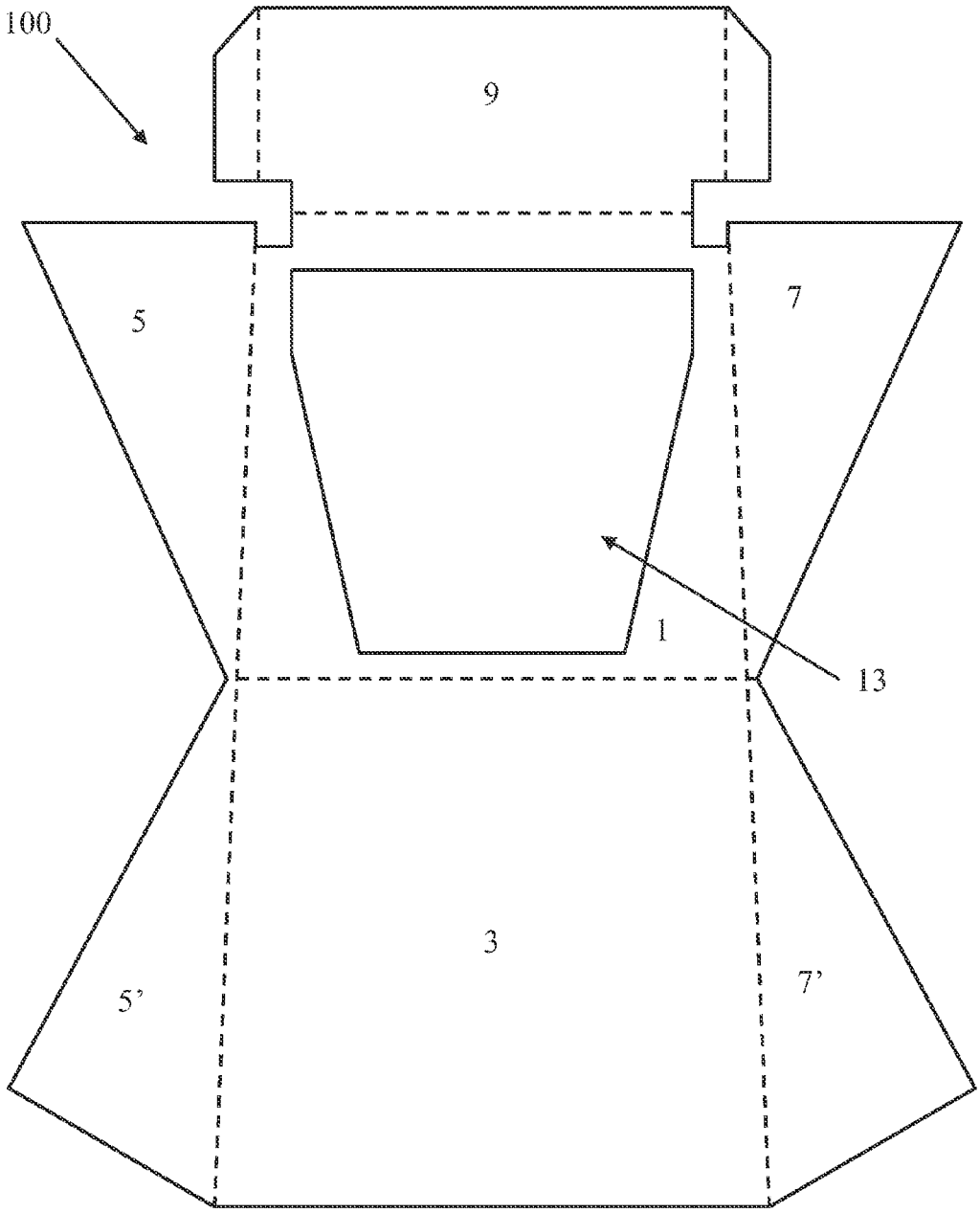
FIG. 10 is a top view depicting the uni-body construction of one embodiment of the present invention.

Still in other embodiments, aperture 13 may be single, larger "cut-out" of appropriate size and shape to allow the use of a wide variety of cup configurations, the cups being supported by cup support panel 11. For example, the cut-out may be circular, trapezoidal, rectangular, square, or any other suitable shape. FIG. 10 depicts one such embodiment. Such a configuration provides maximum flexibility in the arrangement, size, and shape of the cups.

It yet other embodiments, top panel 1 does not have apertures 13 itself; rather, a secondary grid panel (not shown) that is adapted to be secured to top panel 1 by hook-and-loop fasteners, double-sided tape, snaps, buttons or the like. The grid panel includes apertures 13, rather than top panel 1. Accordingly, a user can have a variety of grid panels, with a variety of aperture 13 configurations which can be swapped in and out as desired.

With reference to FIG. 2, some embodiments of the present invention may have notches 17 and 19 located at the rear corners of top panel 1, which expose support rod 21. In some embodiments, support rod 21 is disposed within top panel 1 or back panel 9 or may simply be attached thereto. In some embodiments, support rod 21 is adapted to releasably engage attachments means in order for device 100 to be secured to a wall surface or other rigid structure. Preferably, when mounted to a wall surface or a suitable rigid structure, top and bottom panels 1 is substantially perpendicular to the wall surface or rigid structure.

Figure 3:
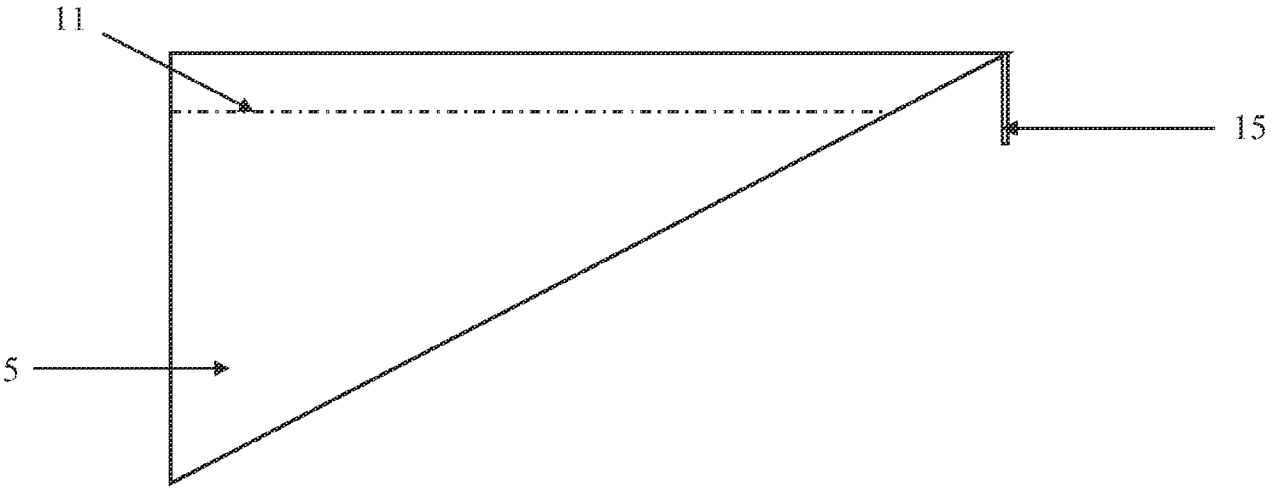
FIG. 3 is a left side view of one embodiment of the present invention.

In some embodiments, the attachment means may be hooks or standard picture hangers that are adapted to attach to wall or other rigid structure. In this case, support rod 21 is adapted to pivotably engage the attachment means, permitting the entire device 100 to pivot upwards for storage. Accordingly, as shown in FIG. 3, clip 23 may be attached to the front edge of device 100 such that when it is pivoted upward, clip 23 can engage a secondary attachment means (such as a hook, picture hanger, or the like), securing the device 100 for storage. Various other fasteners may be used as a replacement for clip 23; such fasteners include, but are not limited to, magnets, hook-and-loop fasteners, double-sided tape, and the like.

Alternatively, the present invention may be nailed or screwed to a wall surface by eyelets or apertures placed at notches 17 and 19. In some embodiments, suction cup mounts may be placed at notches 17 and 19 in order to secure the present invention to a wall surface. In some embodiments, the attachment means may comprise double sided foam tape placed along the back surfaces of left and right supports 5 and 7 or back panel 3. In some embodiments, the attachment means may comprise hook-and-loop fasteners (i.e. Velcro®) adhesively secured along the back surfaces of left and right supports 5 and 7 or back panel 3 wherein the corresponding loop (or hook) material is adhesively secured to the wall or rigid structure. Of course the above described attachment means shall not be construed as limiting as there are a multitude of practical equivalents known to those skilled in the art. Finally, it is understood that the present invention need not be limited to being mounted on a wall surface; rather, the present invention is suitable to be mounted on any rigid structure capable of supporting the weight and dimension of device 100. Such rigid structures may include, without limitation, an easel, a piece of furniture (i.e. a desk, side table, sofa, chair, bookshelf), or a ceiling surface.

Figure 4:
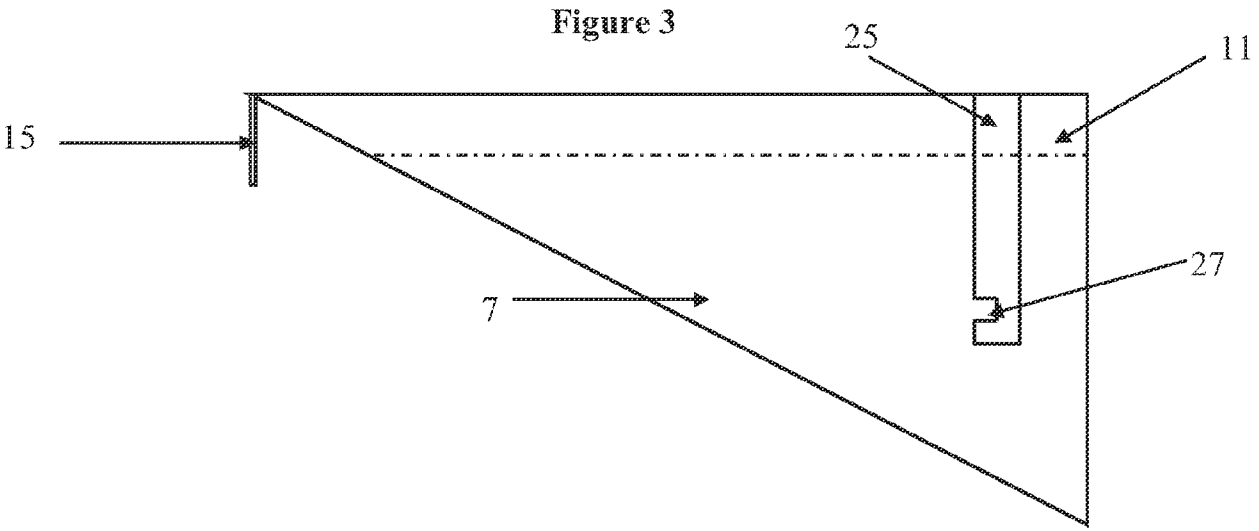
FIG. 4 is a right side view of one embodiment of the present invention.
Figure 5:
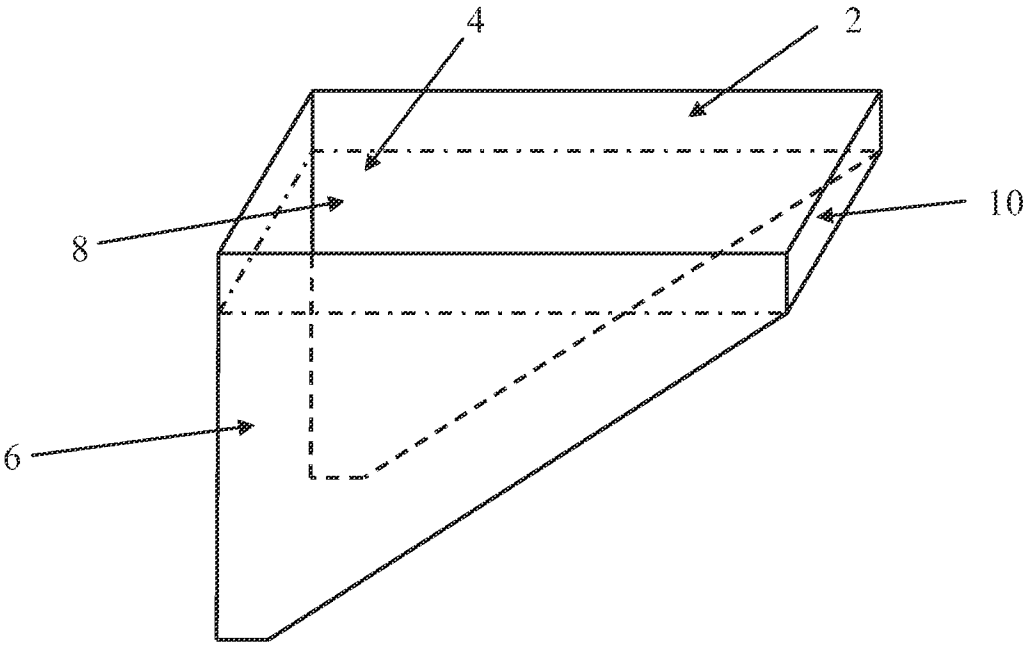
FIG. 5 is an aspect view of another embodiment of the present invention.

FIG. 3 is a side of view of left panel 5 and FIG. 4 shows a side view of right panel 7 with ball holder 25 having opening 27, which may be an optional accessory. Ball holder 25 may be permanently or removably attached to either left panel 5 or right panel 7. In one embodiment ball holder 25 is substantially cylindrical in shape and may have a cross-sectional diameter slightly larger than a standard ping-pong ball. Holder 25 may be of any suitable length depending on be number of balls one desires it to retain. For example, holder 25 may be of sufficient height to retain six (6) ping pong balls stacked vertically one on top of the other. Opening 27 located substantially near the bottom of holder 25 and is dimensioned such that holder 25 can retain a stack of balls during normal operating conditions while still permitting a user to remove one or more balls as desired.

In addition to ball holder 25, optionally attached to either left panel 5 or right panel 7 may be a timer, such as a digital stopwatch or LED or LCD clock or other equivalent for timing the length of a game. Placement of the timer shall not be limited to the either left panel 5 or right panel 7; rather, the timer could be attached to any suitable support of the present invention.

Further, one or more game counters may be attached to either left panel 5 or right panel 7, or both. In one embodiment, such a game counter could be a traditional abacus-style "bead" counter comprising a primary shaft with a plurality of numbered or unnumbered beads which are slideably attached to the shaft. Additionally, any type of LED/LCD digital counter may be equally suitable. Of course, it will be apparent to those skilled in the art that any number of suitable substitutes to the aforementioned. game counters may be implemented. Placement of the game counter shall not be limited to the left and right supports 5 and 7; rather, the timer FIGS. 5-9 depict another embodiment of the present invention, having a slightly different construction from the embodiment shown in FIGS. 1-4. Shown is device 200 with top panel 2, cup support panel 4, left panel 6, and right panel 8. In one embodiment, top panel 2 is disposed between left panel 6 and right panel 8 toward the top of the left and right panels 6 and 8, and in a substantially perpendicular orientation relative to the left and right panels 6 and 8. Cup support panel 4 may likewise be between the left panel 6 and right panel 8, at a location below that of top panel 2. Accordingly, top panel 2 and cup support panel 4 are substantially parallel to one another and separated by gap 10. It should be understood that the particular vertical placement of the top panel 2 and the cup support panel 4, relative to left and right panels 6 and 8 can vary as desired. In some embodiments, a third and/or fourth panel (not shown) may be located at the front and/or back of the top panel 2 and cup support panel 4, covering gap 10 from the front and/or the back, respectively. It is understood that left and right panels 6 and 8 may be of any suitable shape, such as wedge-shaped, rectangular, triangular, or the like. Further, in some embodiments, panels 6 and 8 can comprise a series of elements as a "frame" rather than a planar surface.

Figure 6:
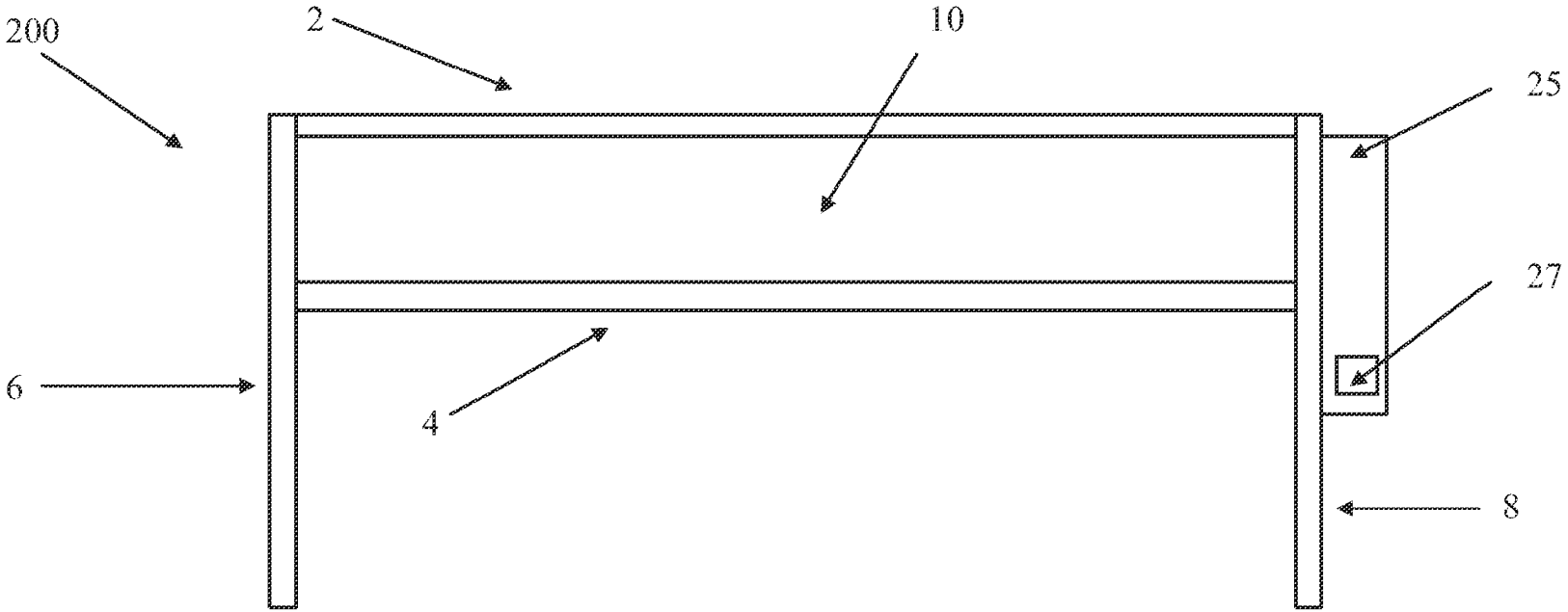
FIG. 6 is a front view of another embodiment of the present invention.
Figure 7:
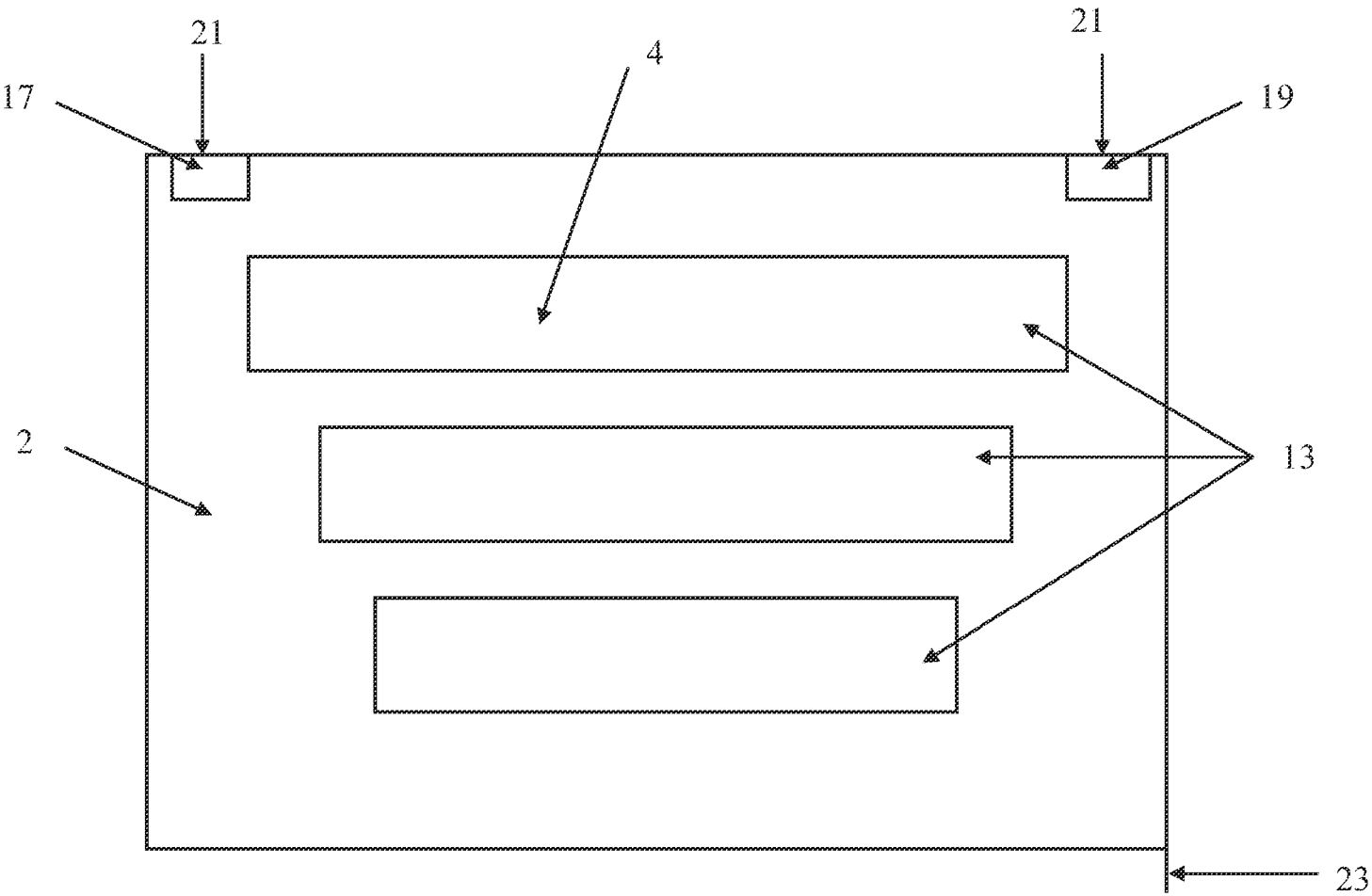
FIG. 7 is a top view of another embodiment of the present invention.
Figure 8:
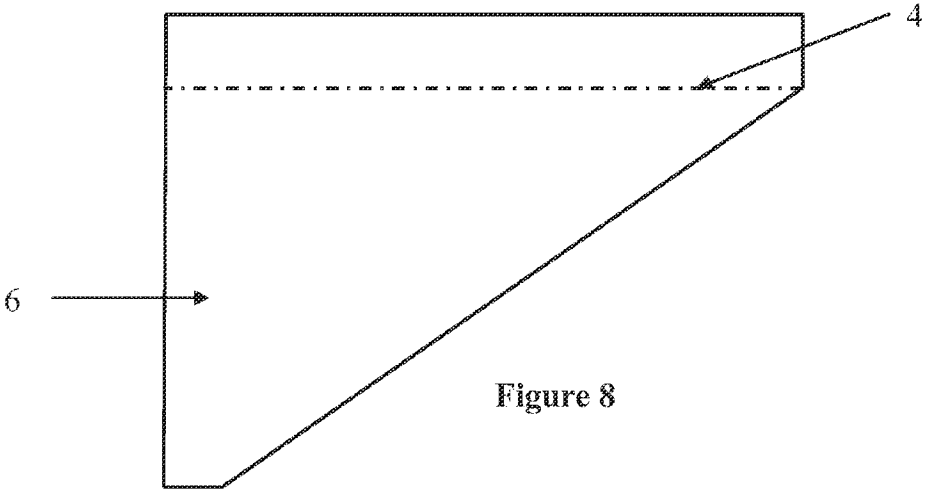
FIG. 8 is a left side view of another embodiment of the present invention.
Figure 9:
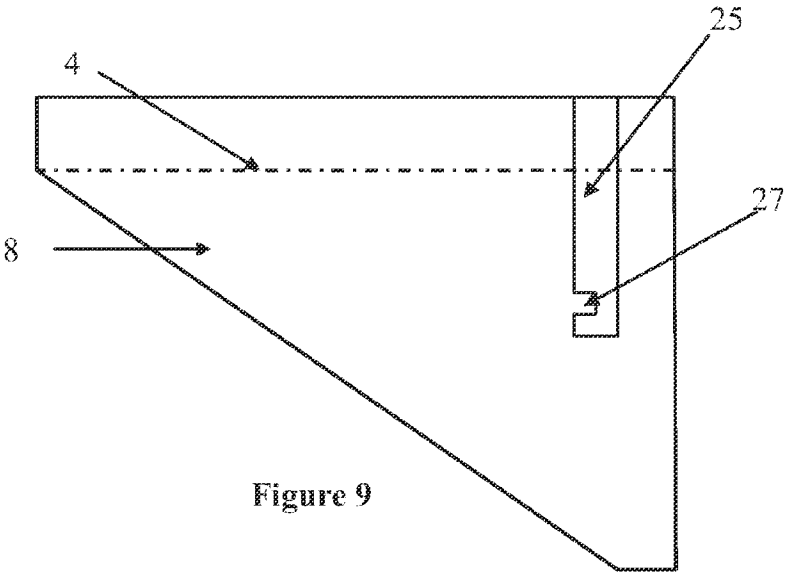
FIG. 9 is a right side view of another embodiment of the present invention.

It is understood that device 200 may optionally have similar features to that of device 100. For example, as shown in FIG. 6, top panel 2 may have apertures 13 in accordance with the above description, wherein cup support panel 4 provides vertical support for cups disposed within device 200. Further, cup support panel 4 may be omitted in its entirety and the cups would be supported only by apertures 13 on top panel 2. Further, device 200 may have ball holder 25 having opening 27 attached to left panel 6 or right panel 8. As shown in FIG. 7, device 200 may have notches 17 and 19 located at the rear corners of top panel 2, which expose support rod 21. Accordingly, device 200 may be attached to a wall surface or rigid structure by the same attachment means discussed above, such as hooks, picture hanger, or the like. Device 200 may also be adapted to pivotably engage such attachment means, such that it can pivot upwards and be secured to a wall surface or rigid structure by clip 23, or hook-and-loop fasteners, double sided tap, or other known fasteners. FIGS. 8 and 9 provide additional views of device 200, depicting left panel 6 and right panel 8. Device 200 may optionally have attached thereto any number of accessories such as the clock or game counter described above.

Devices 100 and 200 may be constructed in accordance with means known in the art. In some embodiments, device 100 and 200 may have a "uni-body" construction as shown, for exemplary purposes, in FIG. 10. In these embodiments, the constituent elements of device 100 and/or 200 is constructed from a single planar body 300, having appropriate cut-outs and fold-lines (shown in dashed lines) which delimit the panels and supports of device 100 and/or 200. For example, FIG. 10 shows one embodiment of device 100 with top panel 1, bottom panel 3 left panel 5, right panel 7, back panel 9, and aperture 13. As shown, left panel 5 and right panel 7 are constructed from two elements each, a first ply (shown as 5 and 7) and a second ply (shown as 5' and 7'). In this example, cup support panel 11 is a separate panel that would be inserted into device 100 during assembly.

In some embodiments, the constituent elements (i.e. the panels and supports) of device 100 and 200 can be discrete parts, assembled and attached by known means. Such means may include hook-and-loop fasteners (i.e. Velcro®), double sided tape, snaps, buttons, or other like fastening means known in the art. It is understood that if the supports are removably attached to one another, the present invention will be modular, portable, and collapsible. In some embodiments, the constituent elements of device 100 or 200 may be assembled through the use of interlocking tongue-and-groove joints or similar interlocking means that do not require fasteners. In some embodiments, the constituent elements of device 100 or 200 can be permanently attached by nails, screws, staples, glue, epoxy, contact cement, welds, or other like means known in the art.

In accordance with the foregoing, the constituent elements of device 100 or 200 may be comprised of without limitation, card board, glass, metal, plastic, wood, plexi-glass, aluminum, marble, and combinations thereof or any other suitable material that provides optimal strength and resiliency. If it is desired for the present invention to be modular, portable, and collapsible it may be preferred to use a lighter material, such as the aforementioned card board, plastic, or plexi-glass. Additionally, the material selected may be capable of being painted or printed with shapes, designs, logos or other indicia. To that end, in some embodiments, the devices 100 (or 200) may also include a sign 15 located at the front periphery of top panel 1 or 2. Sign 15 is adapted to receive written or printed indicia, such as a logo, graphics, drawings or the like. Additionally, in some embodiments, the constituent elements of device 100 or 200 may have shapes, designs, logos or other indicia as "cut-outs" on the various elements, provided the elements have sufficient strength and resiliency to support liquid-filled cups.

In the foregoing description, the present invention has been described with reference to specific exemplary embodiments thereof. It will be apparent to those skilled in the art that a person understanding this invention may conceive of changes or other embodiments or variations, which utilize the principles of this invention without departing from the broader spirit and scope of the invention. The specification and drawings are, therefore, to be regarded in an illustrative rather than a restrictive sense. Accordingly, it is not intended that the invention be limited except as may be necessary in view of the appended claims.

I claim:

1. A game device, comprising:

a top panel, a bottom panel, a left panel, a right panel, and a back panel;

wherein said top panel is disposed laterally between said left panel and said right panel, said top panel oriented substantially perpendicular to said left panel and said right panel;

wherein said back panel is disposed transversely between said left panel and said right panel;

wherein said bottom panel is disposed laterally between said left panel and said right panel, and a front edge of said bottom panel terminates at a front edge of said top panel and a rear edge of said bottom panel terminates at a bottom edge of said back panel;

wherein said top panel has one or more apertures adapted to removably retain one or more cups; and wherein said device is adapted to be secured to a rigid structure by notches located at a back edge of said top panel, said notches including one or more support rods adapted to releasably and pivotably engage one or more hooks or hangers on said rigid structure.

2. The game device according to claim 1, further comprising:

a cup support panel adapted to vertically support said one or more cups, wherein said cup support panel is disposed laterally between said left support and said right support, said cup support panel oriented substantially perpendicular to said left panel and said right panel; and wherein said cup support panel is at an elevation below said top panel.

3. The game device according to claim 1, wherein said one or more apertures comprise one or more rectangular slots.

4. The game device according to claim 1, wherein said one or more apertures comprise one or more circular openings.

5. The game device according to claim 1, wherein said one or more apertures comprises a single cut-out.

6. The game device according to claim 1, further comprising a ball holder attached to said device, wherein said ball holder is adapted to releasably retain one or more game balls.

7. A game device, comprising:

a top panel, a left panel, and a right panel;

wherein said top panel is disposed laterally between said left panel and said right panel, said top panel oriented substantially perpendicular to said left. panel and said right panel;

wherein said top panel has one or more apertures adapted to removably retain one or more cups; and wherein said device is adapted to be secured to a rigid structure by notches located at a back edge of said top panel, said notches including one or more support rods adapted to releasably and pivotably engage one or more hooks or hangers on said rigid structure.

8. The game device according to claim 7, further comprising:

a cup support panel adapted to vertically support said one or more cups, wherein said cup support panel is disposed between said left panel and said right panel, said cup support panel oriented substantially perpendicular to said left panel and said right panel; and wherein said cup support panel is at an elevation below said top panel.

9. The game device according to claim 7, wherein said one or more apertures comprise one or more rectangular slots.

10. The game device according to claim 7, wherein said one or more apertures comprise one or more circular openings.

11. The game device according to claim 7, wherein said one or more apertures comprises a single cut-out.

12. The game device according to claim 7, further comprising, a ball holder attached to said device, wherein said ball holder is adapted to releasably retain one or more game balls.

* * * * *